US007705750B2

(12) United States Patent
Holmberg et al.

(10) Patent No.: US 7,705,750 B2
(45) Date of Patent: Apr. 27, 2010

(54) SYSTEM FOR USE IN STATIONS FOR ROAD TOLLS

(75) Inventors: Mats Holmberg, Jönköping (SE); Martin Löfving, Huskvarna (SE); Magnus Westroth, Vic (AU)

(73) Assignee: Kapsch TrafficCom AB, Jönköping (SE)

( * ) Notice: Subject to any disclaimer, the term of this patent is extended or adjusted under 35 U.S.C. 154(b) by 346 days.

(21) Appl. No.: 11/883,207

(22) PCT Filed: Mar. 22, 2006

(86) PCT No.: PCT/SE2006/000360

§ 371 (c)(1),
(2), (4) Date: Jul. 27, 2007

(87) PCT Pub. No.: WO2006/101442

PCT Pub. Date: Sep. 28, 2006

(65) Prior Publication Data

US 2008/0258937 A1 Oct. 23, 2008

(30) Foreign Application Priority Data

Mar. 22, 2005 (SE) ..... 0500638

(51) Int. Cl.
*G08G 1/017* (2006.01)

(52) U.S. Cl. ..... 340/937; 340/928; 705/13

(58) Field of Classification Search ..... 340/937, 340/928, 905, 936, 933, 935; 705/13, 22; 235/384

See application file for complete search history.

(56) References Cited

U.S. PATENT DOCUMENTS 5,825,007 A 10/1998 Jesadanont
6,034,625 A 3/2000 Mitsuno (Continued)

FOREIGN PATENT DOCUMENTS

EP 0802515 A1 10/1997

(Continued)

OTHER PUBLICATIONS

International Search Report mailed Jun. 19, 2006 in corresponding PCT Application No. PCT/SE2006/000360, 4 pgs.

(Continued)

*Primary Examiner*—Toan N Pham
(74) *Attorney, Agent, or Firm*—Schwegman, Lundberg & Woessner, P.A.

(57) ABSTRACT

The invention relates to a system for use with stations for road tolls, comprising a first optical apparatus for recording images of the roadway and a second apparatus for wireless communication with a vehicle apparatus. The height above the roadway and the angle in a lateral and a vertical direction in relation to the roadway are known for the first apparatus, and the second apparatus can determine coordinates for the vehicle apparatuses in at least two directions through its communication with the vehicle apparatuses. The system comprises means for being able to detect one or more number plates from an image taken using the optical apparatus, and means for calculating the positions of the detected number plates in three directions, and means for being able to determine any associations between number plates and vehicle apparatuses by comparison between the said positions of the number plates and the said positions of the vehicle apparatuses.

15 Claims, 6 Drawing Sheets

U.S. PATENT DOCUMENTS

| | | | | |
|---|---|---|---|---|
| 6,166,659 | A | 12/2000 | Kusano | |
| 6,538,580 | B2 * | 3/2003 | Bostrom et al. | 340/933 |
| 7,233,260 | B2 * | 6/2007 | Tang et al. | 340/928 |

FOREIGN PATENT DOCUMENTS

| | | | |
|---|---|---|---|
| JP | 60-10112 | A | 1/1985 |
| JP | 08-297796 | | 11/1996 |
| JP | 2000-036094 | | 2/2000 |

OTHER PUBLICATIONS

Written Opinion of the International Searching Authority mailed Jun. 19, 2006 in corresponding PCT Application No. PCT/SE2006/000360, 4 pgs.

"European Application Serial No. 06733268.4, Response filed Nov. 4, 2009", 4 pgs.

"European Application Serial No. 06733268.4, Supplementary European Search Report mailed Sep. 14, 2009", 6 pgs.

* cited by examiner

SYSTEM FOR USE IN STATIONS FOR ROAD TOLLS

RELATED APPLICATIONS

This application is a nationalization under 35 U.S.C. 371 of PCT/SE2006/000360, filed Mar. 22, 2006 and published as WO 2006/101442 A1 on Sep. 28, 2006, which claimed priority under 35 U.S.C. 119 to Sweden Patent Application Serial No. 0500638-2, filed Mar. 22, 2005; which applications and publication are incorporated herein by reference and made a part hereof.

TECHNICAL FIELD

The present invention relates to a system for use with stations for road tolls, and comprises a first optical apparatus for recording images of the roadway and a second apparatus for wireless communication with a vehicle apparatus.

The height above the roadway and the angle in a lateral direction and a vertical direction in relation to the roadway are known for the first apparatus, and the second apparatus can determine coordinates for the vehicle apparatuses in at least two directions by means of its communication with the vehicle apparatuses.

BACKGROUND ART

In systems for payment of road tolls or road charges, a well-known method is to equip vehicles with a vehicle apparatus of some kind, often a transponder, the task of which is to effect the payment of the road toll or the road charge by communication with the system. Such vehicle apparatuses often communicate with the system by wireless means, for example via radio or infrared means.

In order to check that the vehicle on the roadway is equipped with a transponder and in order to be able to detect, identify and charge vehicles that are not equipped with a transponder, cameras or the like are often used for photographing vehicles on the roadway.

The images that are taken of vehicles can then be matched with the transponders from which signals have been received, and, on the basis of this information, it can then be determined in various ways which vehicles have not been equipped with transponders.

In order to be able to match vehicles and transponders, it is necessary to know the position of both the vehicles and the transponders. The position of the transponders can be obtained by means of their wireless communication with the system, for example by taking bearings. The position of the vehicles is obtained by means of the image or images, and by knowing where on the roadway the vehicles were located when the image was taken. On the basis of the positions of both the transponders and the vehicles that are known in this way, matching can be carried out, and vehicles without transponders can be found.

The position of the vehicles is thus obtained using the fact that it is known where the vehicles are located on the roadway when the images are taken, which is known as the images are taken when the vehicle passes by some type of apparatus, usually arranged in or at the side of the roadway, that triggers the taking of the image.

A problem in this connection is that the apparatus that triggers the taking of the image is expensive and difficult to maintain.

DISCLOSURE OF INVENTION

In accordance with what has been described above, there is thus a problem in systems for road tolls or road charges in that, in order to be able to determine a vehicle's position from an image, an apparatus is required that can trigger the taking of an image when the vehicle passes by a particular point on the roadway. It is thus desirable to be able to determine the position of a vehicle from only one image, without the need for an apparatus that triggers a camera.

This requirement is met by the present invention in that it describes a system for use in stations for road tolls. The system according to the invention comprises a first optical apparatus for recording images of a roadway, and a second apparatus for wireless communication with a vehicle apparatus.

The height above the roadway of the first apparatus and its angle in the lateral and vertical directions in relation to the roadway are known, and the second apparatus can determine coordinates for the vehicle apparatus in at least two directions by means of its communication with the vehicle apparatus.

The system according to the invention comprises, in addition, means for being able to detect one or more vehicle number plates from an image taken using the optical apparatus, and means for calculating the positions of the detected number plates in three directions.

The system also comprises means for being able to determine any association between number plates and vehicle apparatuses by means of comparisons between the said positions of the number plates and the said positions of the vehicle apparatuses.

BRIEF DESCRIPTION OF DRAWINGS

The invention will be described in greater detail in the following, with reference to the attached drawings, in which.

MODES FOR CARRYING OUT THE INVENTION

Figure 1:
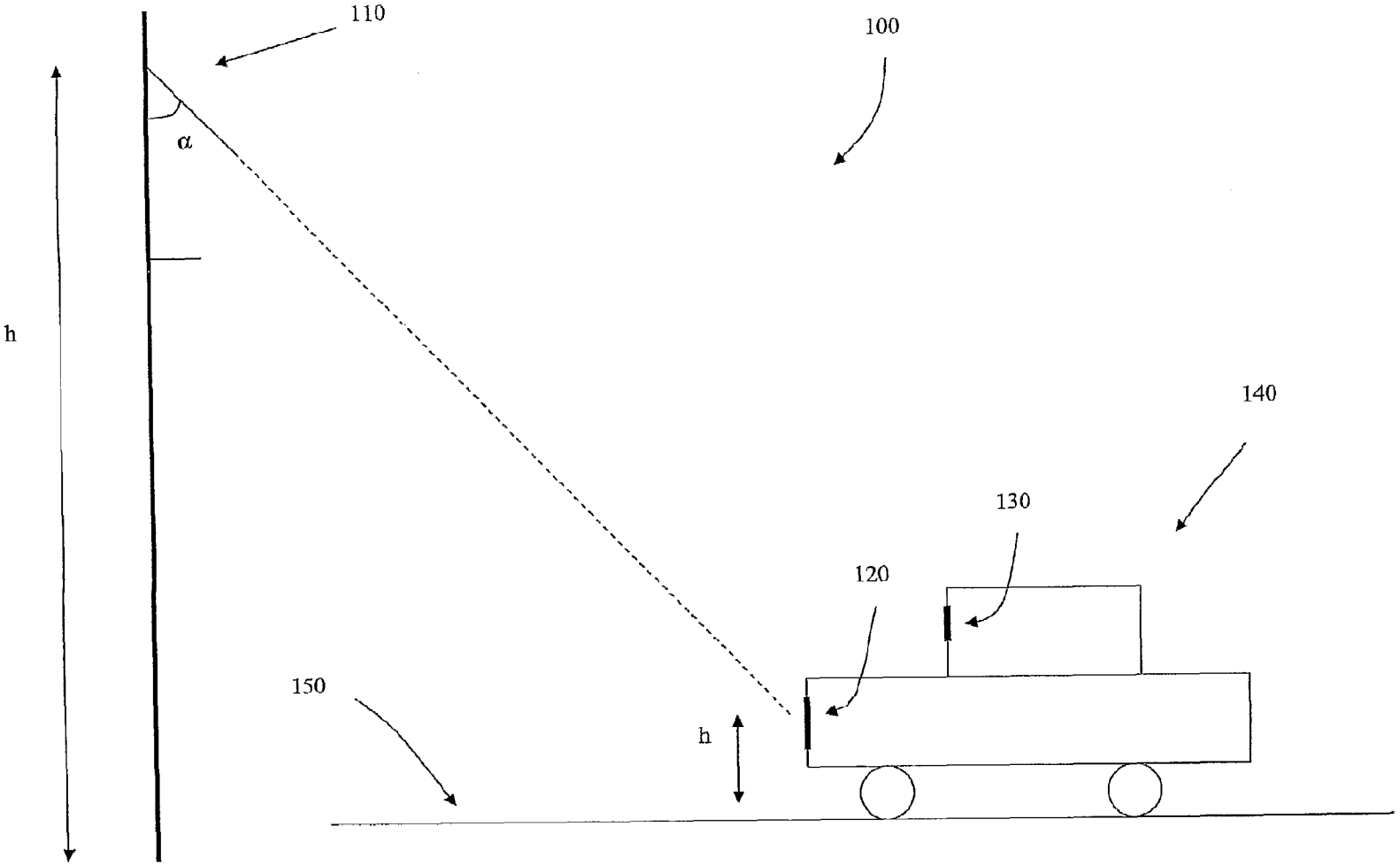
FIG. 1 shows a schematic side view of a system according to the invention.

FIG. 1 shows a schematic drawing of a system 100 according to the invention. The system 100 comprises an apparatus 110 for optical recording of a roadway 150 and accordingly also recording of a vehicle 140 that is moving along the roadway.

The apparatus 110 for optical recording, normally some type of camera, is arranged at a known vertical angle $\alpha$ in relation to the roadway, at a known height h above the roadway.

A vehicle 140 is moving along the roadway 150, which vehicle has a number plate 120 and, in addition, is equipped with a second vehicle apparatus 130 for communication with a corresponding apparatus in the system (in addition to the optical apparatus). The vehicle apparatus is suitably able to communicate with the apparatus in the system by wireless means, for example by radio or infrared means.

Figure 2:
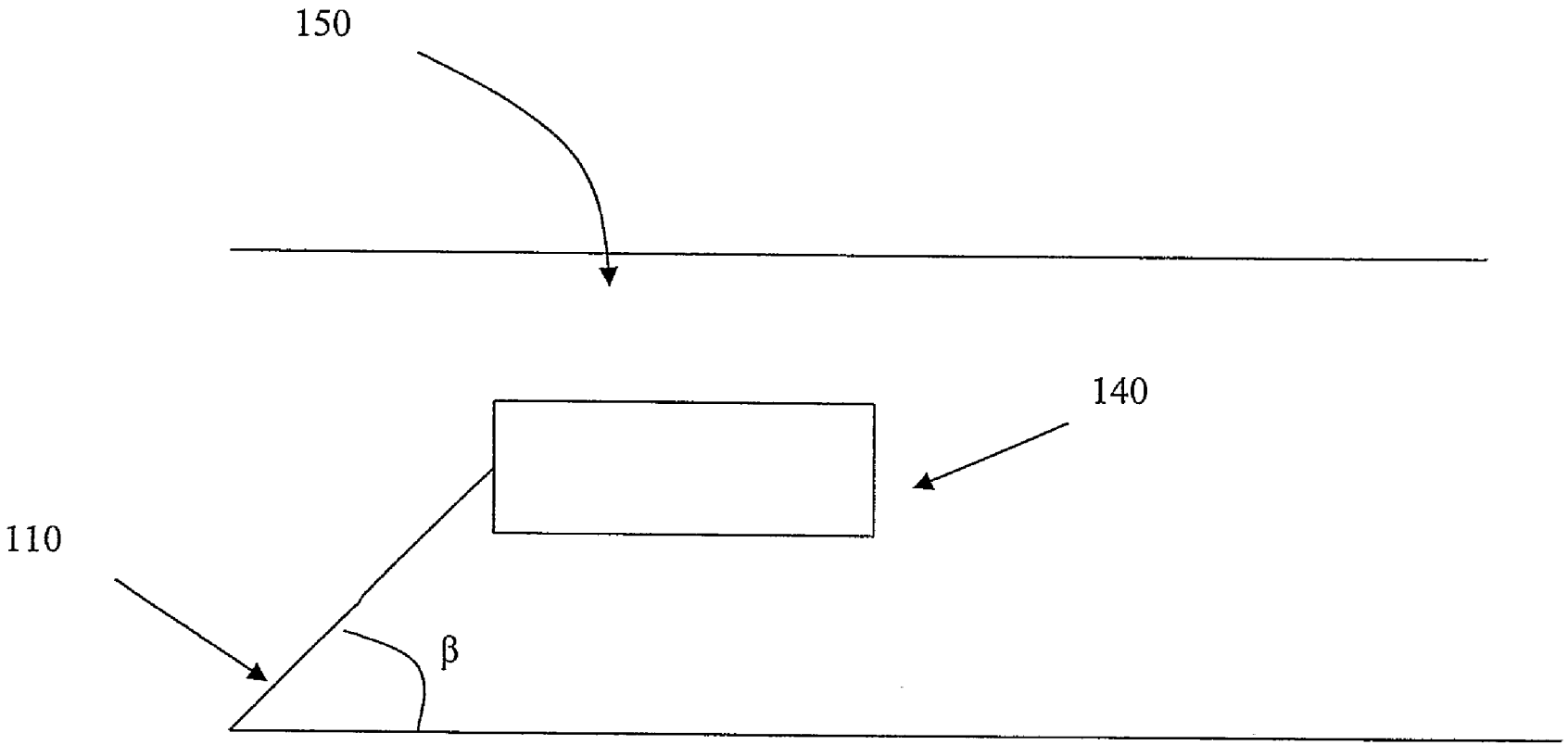
FIG. 2 shows a schematic view from above of the system in FIG. 1.

FIG. 2 shows the system from FIG. 1 viewed from above. It can be seen in this drawing that the lateral angle β of the camera 110 in relation to a vehicle that it is photographing or recording is also known.

The purpose of the vehicle apparatus 130 is usually to assist in the charging of the vehicle or the debiting of an account that the driver or owner of the vehicle has for toll charges or road charges. In order to be able to identify vehicles that are driving on the roadway without transponders, and in order to be able to determine the association between the transponders that are on the roadway and the vehicles that are on the roadway, images are used that are taken by the camera 110. In the system according to the invention, the camera 110 takes images of the roadway continuously, either at regular intervals or at previously determined times.

A task of the system according to the invention is, as mentioned above, to make associations between signals from transponders and images of vehicles in order in this way, among other things, to be able to identify vehicles that do not have transponders. In order to be able to make these associations, the positions are required both of all the transponders and of all the vehicles that are included in the images.

The positions of the transponders can be obtained in a number of ways, suitably by means of their wireless communication. Examples of such ways are triangulation or, particularly for radio communication, by using a plurality of receiver antennas in the apparatus that receives signals from the transponder. By measuring the phase difference between signals received in the different antennas, it is possible to work out an angle to the transponder, and thus, by arranging a plurality of receiver antennas along the longitudinal direction of the roadway and in a vertical direction, it is possible to work out the lateral angle and vertical angle to a transponder from a point on or above the roadway, if the height of the receiver antennas above the roadway is known.

The system according to the invention comprises, in addition, means for being able to detect one or more vehicle number plates from an image taken using the optical apparatus, and, in addition, means for determining the positions of detected number plates in three directions.

The means for detecting number plates utilizes image processing. Precisely what method is used is of no significance for the invention, but, as an example, algorithms can be used that are based on finding contrast patterns in the image in the shape of a number plate. By means of image processing, any number plates that are in each image are detected, along with their position in the image.

The expression "their position in the image" means here that it is possible to determine the position of a certain point in the number plate, for example its centre point, in the image. Another way of expressing this is to say that it can be found out which pixel in the image corresponds to a certain given point in the number plate, for example its centre point or one corner.

As the vertical angle and lateral angle for the camera in relation to the roadway are known, it is possible to calculate the position of the said point on the number plate in two directions in the image, namely vertically and laterally. As the camera in the system according to the invention takes images continually or at certain particular intervals, it is not known, however, at what distance from the camera the vehicle was located when the image was taken.

Figure 3:
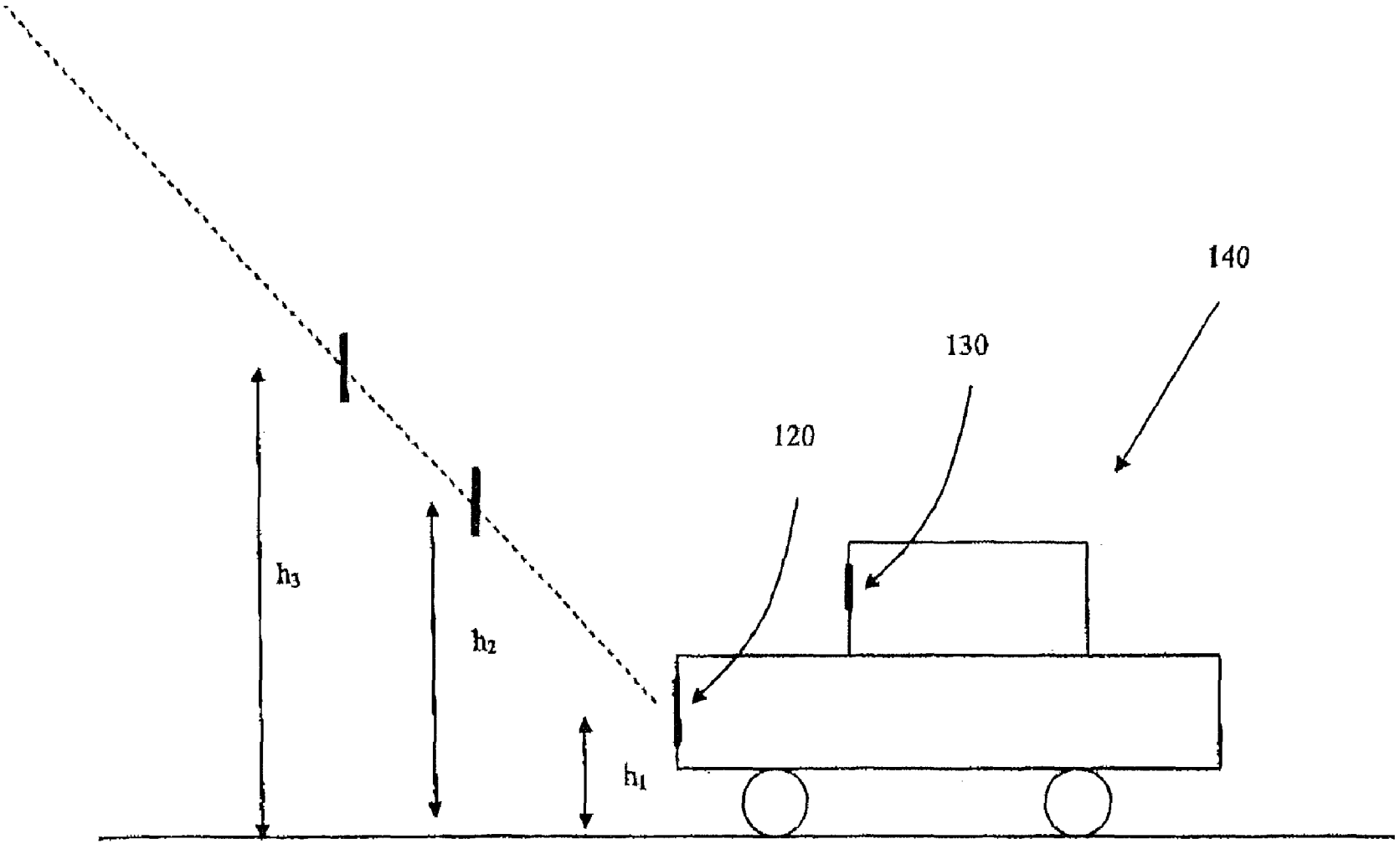
FIG. 3 shows a problem that is solved by the present invention.

The uncertainty regarding the distance of the vehicle 140 from the camera 110 when the image was taken leads to an ambiguity which is illustrated in FIG. 3: one and the same image with one and the same position in the image can be obtained for a number plate at a large number of different heights, $h_1$, $h_2$, $h_3$, . . . above the roadway. In the example in FIG. 3, it is the height $h_1$ that is the correct height, but with the available information, in other words the vertical angle and lateral angle between the camera and the vehicle, the system is not able to know this.

The situation is identical for the position of the transponder 130 in relation to the apparatus with which the transponder communicates: the height of the transponder above the roadway is not known. All that is known are the lateral and vertical angles between the transponder and the apparatus in the system.

Figure 4:
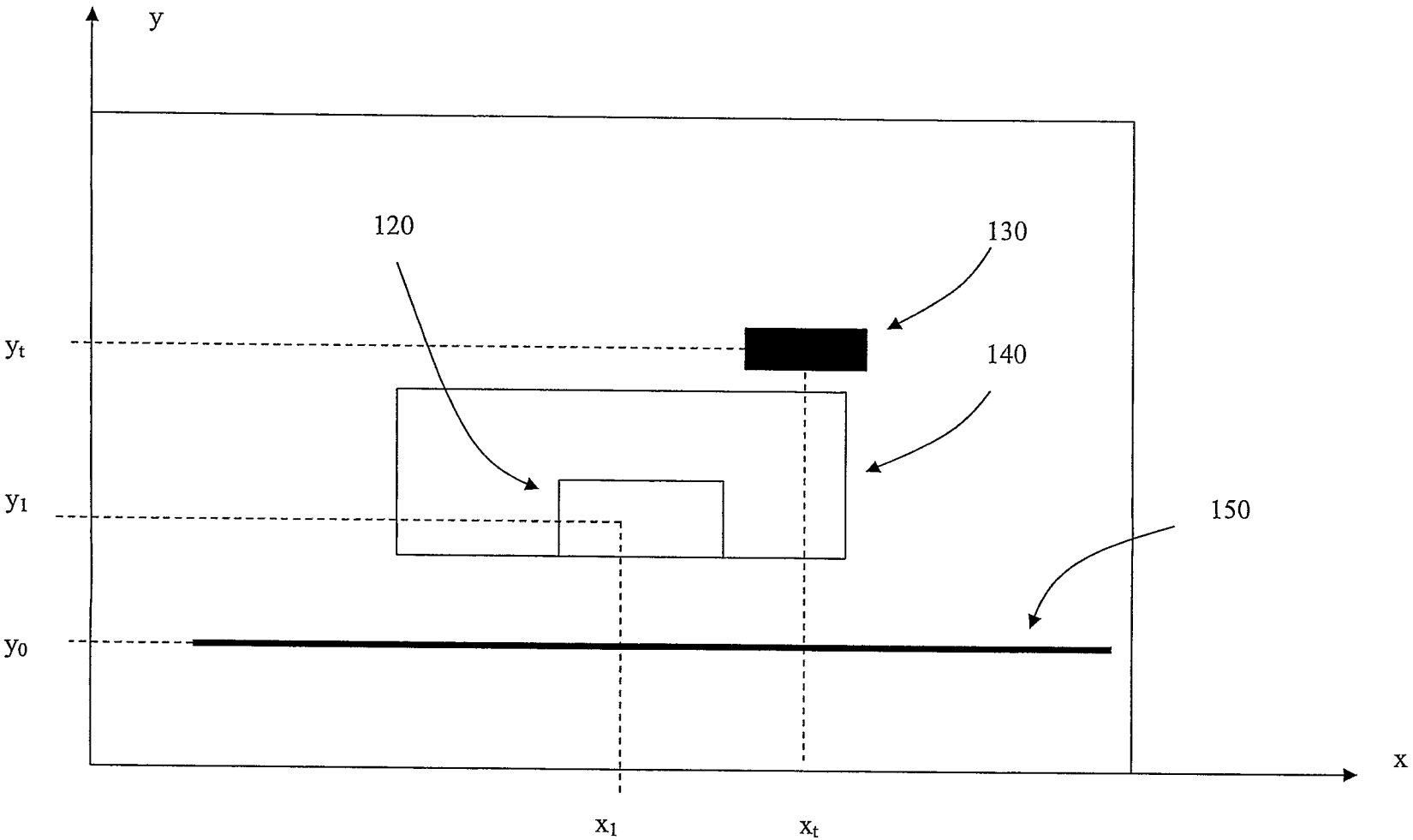
FIG. 4 shows a method according to the invention.

The example in FIG. 4 shows an image that the camera 110 has taken of a vehicle 140. The image is regarded by the image-processing apparatus as a system of coordinates, with an x-axis and a y-axis, as shown in FIG. 4. The number plate 120 has been found by the image-processing apparatus, and has been located with x and y coordinates, $x_1$, $y_1$, in the coordinate system. What, however, is not known is the height of the number plate above the roadway 150.

FIG. 4 also shows the known position $x_t$, $y_t$, of the transponder 130 in the x and y directions. The situation is the same for the coordinates of the transponder as for the coordinates of the number plate: the distance $y_t$-$y_0$ is not known, in other words it is not possible to work out from the image the height of the transponder above the roadway.

According to the invention, the system therefore assumes the heights above the roadway for the number plate, $y_1$-$y_0$ and for the transponder $y_t$-$y_0$. This is suitably carried out on the basis of knowledge of the heights on a vehicle at which a number plate and a transponder are usually located.

On the basis of the coordinates that the system now uses, the system can determine the association between number plates and transponders, by calculation and the abovementioned assumptions. This is suitably carried out by flattening the position of all the number plates and transponders that are found in a certain given image into one and the same plane.

Figure 5:
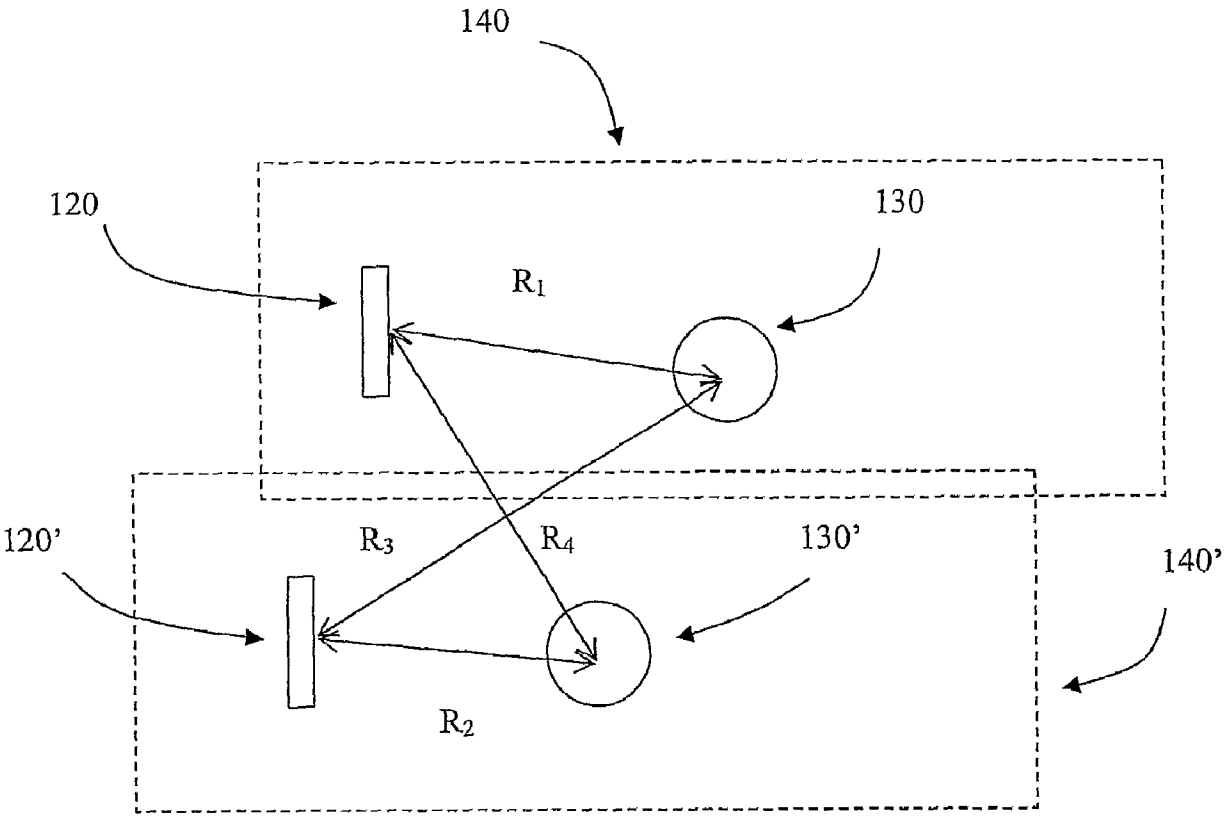
FIGS. 5 and 6 show different solutions to a problem according to the invention.

FIG. 5 shows an image from above of an imaginary or calculated plane, in which the positions have been drawn of a first 120 and a second 120'number plate that the image-processing has found in the image, and, in addition, the positions of a first 130 and a second 130' transponder that have been located in the way described above.

A task of the system is now to find out which of the transponders 130, 130'goes with which of the number plates 120, 120'. The system can, for example, do this by calculating the distance between each combination of number plate and transponder in the shown plane.

FIG. 5 shows the distance between each combination of transponder and number plate as double arrows $R_1$, $R_2$, $R_3$, $R_4$. By means of a further assumption made by the system, namely the distance (suitably in the direction of travel of the vehicle) between the transponder and the number plate, the system can determine which transponder is most likely to belong together with which number plate. How this assumption can be used is shown in FIG. 5: the distances that are judged to be most probable, making the assumptions concerning the distances between the number plate and transponder, are the distances $R_1$ and $R_2$, which then indicates that it is the second number plate 120' that goes with the second transponder 130', and that it is the first number plate 120 that goes with the first transponder 130. In FIG. 5, broken lines indicate the outlines of possible vehicles 140, 140'that conform to the associations between number plates and transponders that have now been determined.

Figure 6:
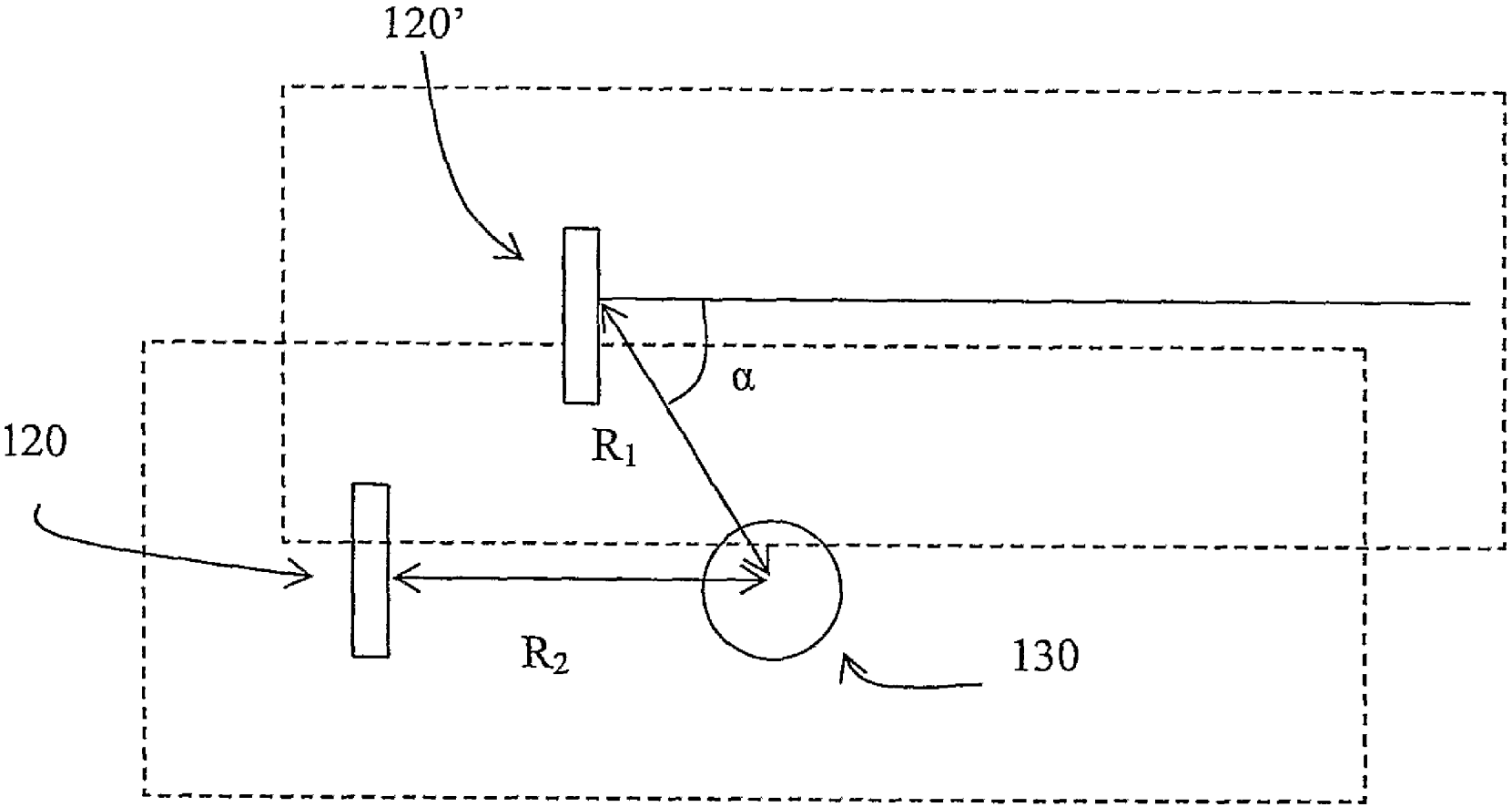

FIG. 5 shows a situation in which there are the same number of transponders as number plates, which is not always the case. FIG. 6 shows a case in which a first 120 and a second

120' number plate have been detected, but only one transponder 130. The task of the system is thus to determine which of the number plates 120, 120' goes with the transponder 130.

In the case that is shown in FIG. 6, the distances $R_1$, $R_2$, from both number plates 120, 120' lie within the limit of what can be regarded as normal, but the angle $\alpha$ between the second number plate 120' and the transponder 130 is larger than what can be considered to be probable. The system thus determines that it is the first number plate 120 that goes with the transponder 130.

Of course there can be other cases, but the system can always work with the combination of most probable distances or angles between number plates and transponders in order to determine associations.

The invention claimed is:

1. A system for use in stations for road tolls, comprising:

a first optical apparatus for recording images of a roadway, a second apparatus for wireless communication with each of one or more vehicle apparatuses, wherein a height above the roadway and an angle in the lateral and a vertical direction in relation to the roadway are known for the first optical apparatus, wherein the second apparatus can determine a position for each of the one or more vehicle apparatuses in at least two directions through its communication with the vehicle apparatuses, means for being able to detect one or more number plates from an image taken using the first optical apparatus, means for calculating a position for each of the detected number plates in three directions, means for being able to determine any associations between the detected number plates and the one or more vehicle apparatuses by comparison between the position of each of the detected number plates and the position of each of the one or more vehicle apparatuses.

2. The system according to claim 1, wherein the means for calculating the position of each of the detected number plates utilizes an assumed height above the roadway for number plates.

3. The system according to claim 2, wherein the means for making comparisons utilizes an assumed height above the roadway for the one or more vehicle apparatuses.

4. The system according to claim 3, wherein the second apparatus communicates with the one or more vehicle apparatuses via radio means.

5. The system according to claim 4, wherein the second apparatus communicates with the one or more vehicle apparatuses via infra-red means.

6. The system according to claim 4, wherein the second apparatus communicates with the one or more vehicle apparatuses via infra-red means.

7. The system according to claim 1, wherein the means for making comparisons utilizes an assumed height above the roadway for the one or more vehicle apparatuses.

8. The system according to claim 7, wherein the second apparatus communicates with the one or more vehicle apparatuses via radio means.

9. The system according to claim 1, wherein the second apparatus communicates with the one or more vehicle apparatuses via radio means.

10. The system according to claim 1, wherein the second apparatus communicates with the one or more vehicle apparatuses via infra-red means.

11. A road tolling system, comprising:

a first optical apparatus for recording images of a roadway, wherein the first optical apparatus is at a height above the roadway, is at a lateral angle relative to the roadway, and is at a vertical angle relative to the roadway, a second apparatus for wireless communication with one or more vehicle apparatuses, wherein the second apparatus is to determine a position for each of the one or more vehicle apparatuses in at least two directions through its communication with the one or more vehicle apparatuses, a detector in communication with the first optical apparatus, the detector to detect one or more plates from an image taken using the first optical apparatus, a calculator in communication with the detector and operable to calculate a position for each of the detected one or more plates in three directions, and a comparator in communication with the calculator and the second apparatus and to determine any associations between the one or more plates and the vehicle apparatuses by comparison between the position of each of the one or more plates and the position of each of the one or more vehicle apparatuses.

12. The system according to claim 11, wherein the second apparatus is to communicate with the vehicle apparatuses via radio frequency.

13. The system according to claim 11, wherein the second apparatus is to communicate with the one or more vehicle apparatuses via infra-red.

14. The system according to claim 11, wherein the comparator utilizes an assumed height above the roadway for the one or more vehicle apparatuses.

15. The system according to claim 11, wherein the calculator utilizes an assumed height above the roadway for the one or more plates.

* * * * *